US010373576B2

(12) United States Patent
Xiao et al.

(10) Patent No.: US 10,373,576 B2
(45) Date of Patent: Aug. 6, 2019

(54) LIQUID CRYSTAL DISPLAY DRIVING APPARATUS INCLUDING PIXEL VOLTAGE DRIVING CIRCUIT FOR PROVIDING PERIODICAL PULSE HIGH-VOLTAGE SIGNAL

(71) Applicants: BOE TECHNOLOGY GROUP CO., LTD., Beijing (CN); BEIJING BOE OPTOELECTRONICS TECHNOLOGY CO., LTD., Beijing (CN)

(72) Inventors: Xiangchun Xiao, Beijing (CN); Lujiang Huangfu, Beijing (CN); Haiyu Zhao, Beijing (CN); Hongming Zhan, Beijing (CN)

(73) Assignees: BOE TECHNOLOGY GROUP CO., LTD., Beijing (CN); BEIJING BOE OPTOELECTRONICS TECHNOLOGY CO., LTD., Beijing (CN)

( * ) Notice: Subject to any disclaimer, the term of this patent is extended or adjusted under 35 U.S.C. 154(b) by 230 days.

(21) Appl. No.: 14/817,619

(22) Filed: Aug. 4, 2015

(65) Prior Publication Data

US 2015/0339993 A1 Nov. 26, 2015

Related U.S. Application Data

(63) Continuation of application No. 12/892,022, filed on Sep. 28, 2010, now abandoned.

(30) Foreign Application Priority Data

Sep. 28, 2009 (CN) ..... 2009 1 0093752

(51) Int. Cl.
*G09G 3/36* (2006.01)

(52) U.S. Cl.
CPC ..... *G09G 3/3614* (2013.01); *G09G 3/3655* (2013.01); *G09G 3/3688* (2013.01);
(Continued)

(58) Field of Classification Search
CPC ..... G09G 2310/06; G09G 2310/063; G09G 2320/0247; G09G 2320/0257;
(Continued)

(56) References Cited

U.S. PATENT DOCUMENTS 5,442,370 A 8/1995 Yamazaki et al.
5,926,162 A * 7/1999 Wood ..... G09G 3/3648 345/101

(Continued)

FOREIGN PATENT DOCUMENTS

CN 1356682 A 7/2002
CN 1713266 A 12/2005

(Continued)

OTHER PUBLICATIONS

Chinese Office Action dated Nov. 6, 2009; Appln. No. 2007101207324.

(Continued)

*Primary Examiner* — Michael J Jansen, II
(74) *Attorney, Agent, or Firm* — Ladas & Parry LLP

(57) ABSTRACT

A liquid crystal display driving apparatus including a pixel voltage driving circuit for providing a periodical pulse high-voltage signal is provided. The liquid crystal display driving apparatus includes: a gate driving unit, a source driving unit, and a gate line and a date line intersected with each other to define a pixel region, in which a pixel electrode is provided, wherein the source driving unit includes: a pixel voltage driving circuit for providing a unidirectional voltage signal applied to the pixel electrode in the pixel region and for providing a periodical pulse high-voltage signal; and a common voltage driving circuit for providing a common (Continued)

voltage signal which corresponds to the unidirectional voltage signal provided by the pixel voltage driving circuit.

7 Claims, 8 Drawing Sheets

(52) U.S. Cl.
CPC ... *G09G 2310/06* (2013.01); *G09G 2310/063* (2013.01); *G09G 2320/0247* (2013.01); *G09G 2320/0257* (2013.01); *G09G 2320/0276* (2013.01); *G09G 2330/021* (2013.01)

(58) Field of Classification Search
CPC ..... G09G 2320/0276; G09G 2330/021; G09G 3/3614; G09G 3/3655; G09G 3/3688
See application file for complete search history.

(56) References Cited

U.S. PATENT DOCUMENTS

| | | | | |
|---|---|---|---|---|
| 5,940,055 | A * | 8/1999 | Lee | G09G 3/3677 345/205 |
| 6,034,943 | A * | 3/2000 | Kwon | H04L 49/153 370/219 |
| 6,225,992 | B1 | 5/2001 | Hsu et al. | |
| 6,518,946 | B2 | 2/2003 | Ode et al. | |
| 6,707,524 | B2 * | 3/2004 | Kim | G02F 1/134363 349/141 |
| 7,098,885 | B2 * | 8/2006 | Kumada | G09G 3/3614 345/87 |
| 7,477,221 | B2 * | 1/2009 | Miyazawa | H03K 19/00315 345/204 |
| 7,864,167 | B2 * | 1/2011 | Morosawa | G09G 3/325 345/204 |
| 8,044,917 | B2 * | 10/2011 | Oh | G09G 3/3677 345/100 |
| 8,054,262 | B2 * | 11/2011 | Kim | G09G 3/3655 345/87 |
| 8,120,565 | B2 * | 2/2012 | Nishimura | G09G 3/3611 345/209 |
| 8,184,076 | B2 * | 5/2012 | Katayama | G09G 3/3648 345/100 |
| 2001/0024183 | A1 * | 9/2001 | Ode | G09G 3/2011 345/87 |
| 2002/0067453 | A1 * | 6/2002 | Kim | G02F 1/134363 349/141 |
| 2003/0151572 | A1 | 8/2003 | Kumada et al. | |
| 2005/0140634 | A1 | 6/2005 | Takatori | |
| 2005/0168430 | A1 * | 8/2005 | Nishimura | G09G 3/3611 345/100 |
| 2005/0285113 | A1 | 12/2005 | Miyazawa et al. | |
| 2006/0139251 | A1 | 6/2006 | Morosawa et al. | |
| 2008/0001886 | A1 | 1/2008 | Kim et al. | |
| 2008/0001894 | A1 | 1/2008 | Oh et al. | |
| 2008/0049001 | A1 * | 2/2008 | Liu | G09G 3/3696 345/204 |
| 2009/0051837 | A1 | 2/2009 | Xiao | |
| 2010/0231814 | A1 | 9/2010 | Yamada et al. | |
| 2011/0199362 | A1 | 8/2011 | Katayama et al. | |

FOREIGN PATENT DOCUMENTS

| | | | |
|---|---|---|---|
| CN | 1941055 | A | 4/2007 |
| CN | 101373582 | A | 2/2009 |
| JP | 06-034943 | A | 2/1994 |
| JP | 09-230829 | A | 9/1997 |
| KR | 20030095113 | A | 12/2003 |
| KR | 20060128447 | A | 12/2006 |
| WO | 2008/029536 | A1 | 3/2008 |

OTHER PUBLICATIONS

USPTO NFOA dated May 7, 2013 in connection with U.S. Appl. No. 12/892,022.
USPTO FOA dated Sep. 11, 2013 in connection with U.S. Appl. No. 12/892,022.
USPTO NFOA dated Nov. 25, 2013 in connection with U.S. Appl. No. 12/892,022.
USPTO FOA dated Apr. 30, 2014 in connection with U.S. Appl. No. 12/892,022.
USPTO NFOA dated Nov. 6, 2014 in connection with U.S. Appl. No. 12/892,022.
USPTO FOA dated May 4, 2015 in connection with U.S. Appl. No. 12/892,022.
USPTO AA dated Jul. 28, 2015 in connection with U.S. Appl. No. 12/892,022.
USPTO NFOA mailed Aug. 17, 2011 in connection with U.S. Appl. No. 12/125,118.
USPTO FOA mailed Dec. 8, 2011 in connection with U.S. Appl. No. 12/125,118.
USPTO Panel Decision mailed May 21, 2012 in connection with U.S. Appl. No. 12/125,118.
USPTO NFOA dated Oct. 25, 2012 in connection with U.S. Appl. No. 12/125,118.
USPTO NFOA dated Apr. 18, 2013 in connection with U.S. Appl. No. 12/125,118.
USPTO FOA dated Dec. 5, 2013 in connection with U.S. Appl. No. 12/125,118.
USPTO FOA dated May 22, 2014 in connection with U.S. Appl. No. 12/125,118.

* cited by examiner

LIQUID CRYSTAL DISPLAY DRIVING APPARATUS INCLUDING PIXEL VOLTAGE DRIVING CIRCUIT FOR PROVIDING PERIODICAL PULSE HIGH-VOLTAGE SIGNAL

BACKGROUND

An embodiment of the present invention relate to a liquid crystal display driving apparatus and a driving method for the same.

Recently, liquid crystal displays (LCDs) have been the main kind of displays. When a pixel of a LCD displays colors, the bidirectional driving manner is commonly used. If a positive voltage is applied to a pixel for displaying a same gray-level during one frame image, the positive voltage is the voltage drop between a voltage applied on a pixel electrode of an array substrate and a voltage applied on a common electrode of an color filter substrate, such as, +2V, so that liquid crystal molecules between the array substrate and the color filter substrate are tilted at a certain angle; in the next frame when still the same gray-level is displayed, a negative voltage is applied, such as, −2V, so that the liquid crystal molecules are tilted at a same angle in an opposite direction. Aging of the liquid crystal material can be effectively prevented by alternatively applying positive and negative voltages to display images.

However, in practice, when the positive and negative voltages having a same absolute value are applied to the liquid crystal molecules, the liquid crystal molecules are not tilted at the same angle in the opposite directions, so the transmittances of the liquid crystal layer are different in the cases, and a flicker phenomenon may occur when images are displayed by alternatively applying the positive and negative voltages. Positive and negative voltages that are nearly symmetrical with each other are alternatively applied to eliminate the flicker phenomenon. However, in practice, it is difficult to control the degree of the near symmetry when the nearly symmetrical positive and negative voltages are alternatively applied, so the flicker phenomenon cannot be completely avoided.

Meanwhile, the positive and negative voltages are applied to the pixel electrode with respect to the common electrode, so it is required that a power supply can supply a voltage twice as the voltage of the common electrode, which increases the power consumption. In order to produce the positive and negative voltages, two sets of gamma resistors are needed on the printed circuit board (PCB) and the chip on film (COF) of a LCD to provide the pixel voltages applied to the pixel electrode. The two sets of gamma resistors take much space on the PCB and COF and increase the cost of the PCB and COF.

In addition, when the array substrate and the color filter substrate are assembled to form a cell, some impurities may exist in the injected liquid crystal material. The stay position of the impurity ions may migrate under the voltages driving the liquid crystal molecules to tilt. When the LCD displays one image for a long time period, the impurity ions may migrate to a certain location. When the displayed image is changed, the impurity ions staying in a given location cannot move away rapidly, so image sticking may occur. Although image sticking can be prevented by reducing the amount of the impurities while applying a nearly symmetrical driving voltage on the pixel, the impurities cannot be removed completely. Further, the residence of the impurity ions is influenced to different degrees by the voltages in different directions, thus the migration of the impurity ions also are not uniform when the different nearly symmetrical voltages are applied on different pixels for a long time period, and finally image sticking will be formed.

SUMMARY

An embodiment of the present invention provides liquid crystal display driving apparatus comprising: a gate driving unit, a source driving unit, and a gate line and a data line intersected with each other to define a pixel region, in which a pixel electrode is provided. The source driving unit comprises: a pixel voltage driving circuit for providing a unidirectional voltage signal that is applied to the pixel electrode in the pixel region; and a common voltage driving circuit for providing a common voltage signal which is applied to a common electrode and corresponds to the unidirectional voltage signal and for providing a periodical pulse high-voltage signal.

Another embodiment of the present invention provides a liquid crystal display driving apparatus comprising: a gate driving unit, a source driving unit, and a gate line and a date line intersected with each other to define a pixel region, in which a pixel electrode is provided. The source driving unit comprises: a pixel voltage driving circuit for providing a unidirectional voltage signal applied to the pixel electrode in the pixel region and for providing a periodical pulse high-voltage signal; and a common voltage driving circuit for providing a common voltage signal which corresponds to the unidirectional voltage signal provided by the pixel voltage driving circuit.

Still another embodiment of the present invention provides a driving method for a liquid crystal display, comprising: driving method for a liquid crystal display, comprising: applying a unidirectional voltage signal to a pixel electrode in a pixel region; applying a common voltage signal corresponding to the unidirectional voltage signal to a common electrode opposite to the pixel electrode, so that an electric field for tilting liquid crystal is formed between the pixel electrode and the common electrode by the unidirectional voltage signal and the common voltage signal; and applying a periodical pulse high-voltage signal on the pixel electrode or the common electrode so as to form a bias field opposite to the electric field.

Further scope of applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from the following detailed description.

BRIEF DESCRIPTION OF THE DRAWINGS

The present invention will become more fully understood from the detailed description given hereinafter and the accompanying drawings which are given by way of illustration only, and thus are not limitative of the present invention and wherein.

DETAILED DESCRIPTION

Figure 13:
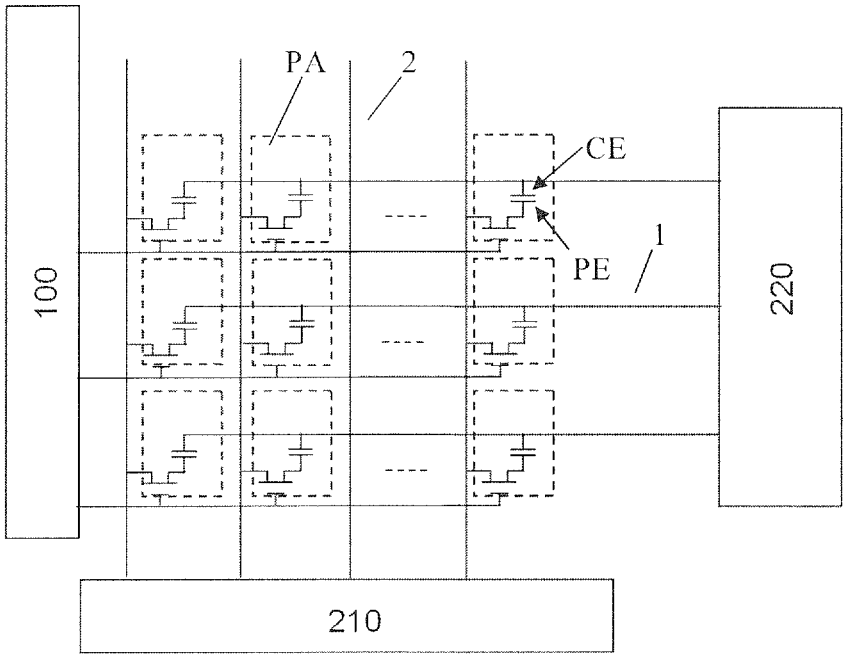
FIG. 13 illustrates a schematic view of a liquid crystal display driving apparatus.

As illustrated in FIG. 13, an embodiment of the present invention provides a liquid crystal display driving apparatus comprising a gate driving unit 100, a source driving unit, a gate line 1 and a date line 2 intersected with each other to define a pixel region PA. The source driving unit of the liquid crystal display driving apparatus comprises a pixel voltage driving circuit 210 and a common voltage driving circuit 220. The pixel voltage driving circuit 210 is used to provide a unidirectional voltage signal applied on a pixel electrode PE in the pixel region PA. The common voltage driving circuit 220 is used to provide a common voltage signal applied on a common electrode CE and corresponding to the unidirectional voltage signal, and used to provide a periodical pulse high-voltage signal, so that it can drive the residence of impurity ions and reverse the tilt of the liquid crystal molecules. When the unidirectional voltage signal is applied to the pixel electrode PE in the pixel region, an electric field between the pixel electrode PE and the common electrode CE drives the liquid crystal molecules to tilt in one direction to transmit light, so the flicker phenomenon caused by different transmittances during application of bidirectional voltage can be effectively constrained. Further, application of the unidirectional voltage signal can reduce the consumption of the power supply of the driving circuit and also can reduce gamma resistors and the cost thereto. The periodical pulse high-voltage signal generated by the common electrode can tilt the liquid crystal molecules in the reverse direction so as to prevent aging of the liquid crystal, which may be caused when the liquid crystal molecules are tilted in one direction under the unidirectional voltage applied to the pixel electrode. On the other hand, the migration of the impurity ions in the liquid crystal molecules is in a saturation state under the high-voltage pulse, but the voltage applied to the liquid crystal molecules is much smaller than the level of the high-voltage pulse signal during normal display so the impurity ions are migrated slowly. In this way, application of the periodical pulse high-voltage signal can keep the impurity ions from moving and always be in a saturation state, and thus the flicker phenomenon can be effectively avoided.

Figure 1A:
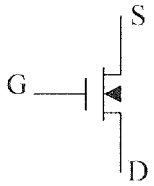
FIG. 1A is a schematic view of an N channel MOS transistor according to the present invention.
Figure 1B:
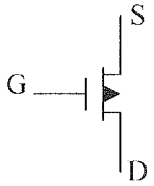
FIG. 1B is a schematic view of a P channel MOS transistor according to the present invention.

Before the liquid crystal display driving apparatus according to the embodiments of the present invention is described, a metal-oxide-semiconductor field-effect transistor (MOSFET) will be described first. FIG. 1A is a schematic view of an N channel MOSFET (NMOS transistor). As shown in FIG. 1A, G electrode refers to a gate electrode, S electrode refers to a source electrode, and D electrode refers to a drain electrode. FIG. 1B is a schematic view of a P channel MOSFET (PMOS transistor). As shown in FIG. 1B, G electrode also refers to a gate electrode, S electrode also refers to a source electrode, and D electrode also refers to a drain electrode. Those skilled in the art know that the source and the drain electrodes in an N channel MOSFET and a P channel MOSFET can be exchanged. The polarities of NMOS transistor and PMOS transistor described hereinafter are same as that shown in FIGS. 1A and 1B, so the reference symbol for the polarities thereof is omitted.

Figure 2:
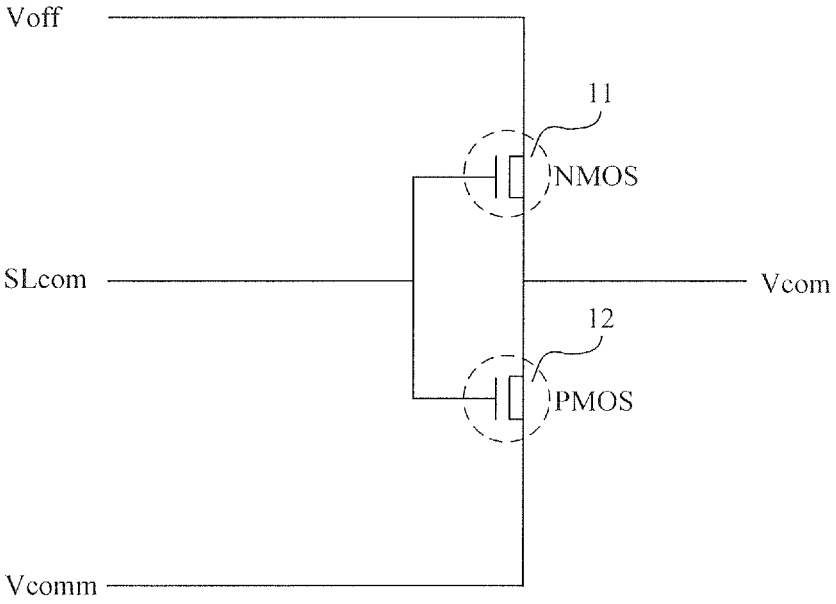
FIG. 2 is a schematic view illustrating a structure of a liquid crystal display driving apparatus according to a first embedment of the present invention.

FIG. 2 is a schematic view of a liquid crystal display apparatus according to a first embodiment of the present invention.

As Shown in FIG. 2, a common voltage driving circuit of a source driving unit in the liquid crystal display driving apparatus comprises: an NMOS transistor 11 and a PMOS transistor 12. The gate electrodes of the NMOS and PMOS transistors 11 and 12 are connected with a first control signal line (SLcom); the source electrode of the NMOS transistor is connected with a first low level signal line (Voff); the drain electrode of the PMOS transistor 12 is connected with a work control signal line (Vcomm); the drain electrode of the NMOS transistor 11 is connected with the source electrode of the PMOS transistor 12 and outputs a common voltage signal (Vcom). The level of the signal Vcomm may be +5V, and the level of the signal Voff may be −5V. The common voltage driving circuit can output a work voltage that is applied to the common electrode, which is Vcomm, and also can output a periodical pulse high-voltage signal under the control of the first control signal SLcom.

In the present embodiment, a pixel voltage driving circuit of the source driving unit in the liquid crystal display driving apparatus provides and applies a unidirectional voltage to the pixel electrode within the pixel region, and the level of the unidirectional voltage may be in the range of 0-5V. The liquid crystal molecules are tilted at a certain angle by the voltage difference between the pixel electrode and the common electrode so as to display a required grey scale. In a liquid crystal display, the different voltages applied to the pixel electrode may be produced by a voltage divider with the gamma resistors, so the voltage difference between the pixel electrode and the common electrode can be different, and then different grey scales can be displayed.

Figure 3:
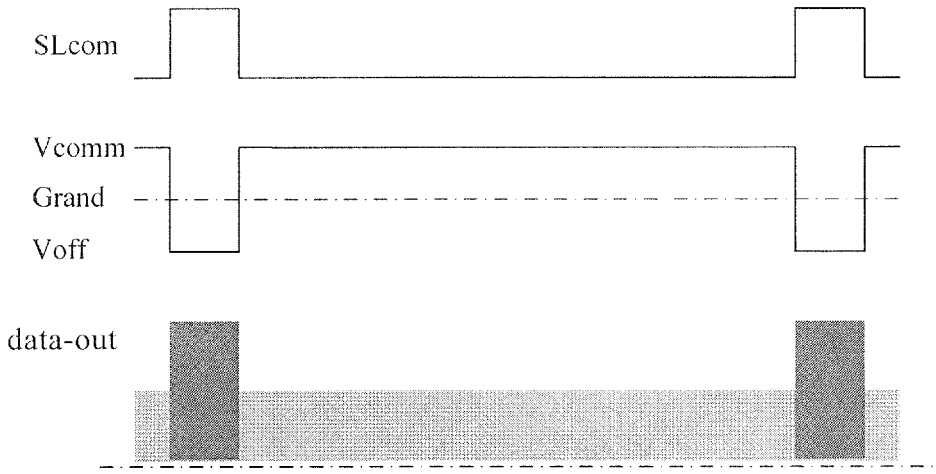
FIG. 3 is a timing sequence view of a common voltage driving circuit shown in FIG. 2.

FIG. 3 is a timing sequence view of the common voltage driving circuit shown in FIG. 2. As shown in FIGS. 3 and 2, when the first control signal SLcom is at a low level, the PMOS transistor 12 is turned on, the common voltage signal Vcom outputted from the source electrode of the PMOS transistor 12 is Vcomm, that is, Vcom=+5V. Here, for example, assuming that a same gray scale is displayed in each frame, that is, the pixel voltages applied to the pixel electrode are the same, if the unidirectional voltage signal applied to the pixel electrode is +2V, the voltage difference in a normal work state is defined by the common voltage signal (+5V) minus the pixel voltage signal (+2V), that is, −3V. Then, the liquid crystal molecules are tilted toward in a direction at a certain angle so as to display a corresponding gray scale. When the first control signal SLcom is at a high level, the NMOS transistor 11 is turned on, the common voltage signal Vcom outputted from the drain electrode of the NMOS transistor 11 is the first low level signal Voff, that is, Vcom=−5V. In this case, the voltage difference is defined by +2V minus −5V, that is, 7V, so a strong bias voltage opposite to and larger than the voltage difference in the normal work state is applied to the pixel. As a result, on one hand, the liquid crystal molecules can be tilted toward the direction opposite to the tilt direction in normal display, and that is, a full white or a full black frame is inserted into the normally displayed frames so aging of the liquid crystal material and the flicker phenomenon are prevented; on the other hand, the migration of all the impurity ions in the liquid crystal layer can be saturated, so that the impurity ions do not move in a certain period during normal display; a periodical strong bias voltage provided due to the periodical pulse of the first control signal SLcom is applied to the common electrode, which can keep the migration of the impurity ions in a saturation state, and thus image sticking can be further alleviated. The frequency and pulse width of the first control signal SLcom can be set arbitrarily as long as the above effect can be achieved. In the embodiment of the present invention, it is preferable that the pulse width is 0.1~10 ms and the period is defined by the pulse width plus the period of one frame.

The liquid crystal display driving apparatus of the present embodiment can improve the quality of the liquid crystal display from the following two aspects.

The first aspect is described below. When the unidirectional voltage signal is applied to the pixel electrode in the pixel region, only one tilt state of the liquid crystal molecules is necessary to consider. Thus, the requirements on the liquid crystal material and the polarization plates become lower, and it can prevent the flicker phenomenon generated by the bidirectional tilts of the liquid crystal molecules when the nearly symmetrical bidirectional voltage is applied. Also, the applied common electrode voltage of the liquid crystal display is changed from a fixed DC voltage into a periodical AC voltage with high-voltage pulse, so that the tilt state of the liquid crystal molecules are completely reversed by the high-voltage pulse of the common electrode voltage during one pulse (for example, a full white image is changed into a full black image), and thus image sticking and the trailing smear due to the persistence of version can be alleviated. Further, in the case of applying the unidirectional voltage, the dynamic range for driving the liquid crystal reduces by almost a half, so the consumption of displaying becomes lower. In addition, the gamma resistor in a COF also reduces by a half, so the cost of the chip is decreased. In this way, the gamma resistor in the chip can be designed according to the requirement of Transmition-Voltage curve.

Gamma resistors (generally being connected to each other in series) are resistors for dividing a voltage, and function to divide a relatively larger range of voltage (commonly AVDD~0V) into a plurality of parts so as to form different reference voltages. According to the different gray levels displayed in each pixel, the driving circuit applies different voltages on the non-common electrode in the pixel. The difference between the voltage of pixel common electrode Vcom and the voltage of non-common electrode forms the actual voltage applied on the liquid crystal layer of the pixel. When the voltages applied on the liquid crystal layer are different, the tilt of the liquid crystal molecules is different, then the transmittances of the light are different, and finally the different gray levels are displayed. Thus, different gray levels require different voltages to be applied on the liquid crystal. Gamma resistors are voltage dividing resistors for generating the voltages required by the different gray levels. Generally, the gamma resistors are divided into two groups, one is to produce a reference voltage higher than Vcom, the other one is to produce a reference voltage lower than Vcom. As such, with respect to the same gray level, a positive voltage and a negative voltage can be alternatively applied on the pixel so as to prevent the decay of the performance of the liquid crystal. In a practice circuit, a voltage is initially divided by the resistors on PCB, and then the initially-divided voltage is divided again by using the resistors connected in series in the chip of COF. Thus, the multiple gray levels display with high performance can be realized.

The second aspect is described below. Because the impurity ions in the liquid crystal migrate to reside under the drive of the nearly symmetric voltage for a long time period, a bias field is generated and affects the tilt of the liquid crystal molecules, and thus image sticking occurs. With the liquid crystal display driving apparatus of the present invention, the migration of all the impurity ions in the liquid crystal layer can be saturated, so the impurity ions do not move in a certain period during normal display. In this way, the migration of the impurity ions can always be kept in the saturation state by application of the periodical strong bias voltage on the common electrode, and thus image sticking can be effectively alleviated. Before and after the saturation state of the migration of the impurity ions is achieved, the VT curve may shift to some degree. In this case, the common voltage signal Vcom for the normal work state is adjusted to compensate the effect of the electric field generated due to the impurity ions in the saturation state. In addition, the strong bias voltage opposite to the voltage for normal display is applied to the common electrode; aging of the liquid crystal material caused by application of unidirectional voltage signal during normal work can be effectively avoided.

Figure 4:
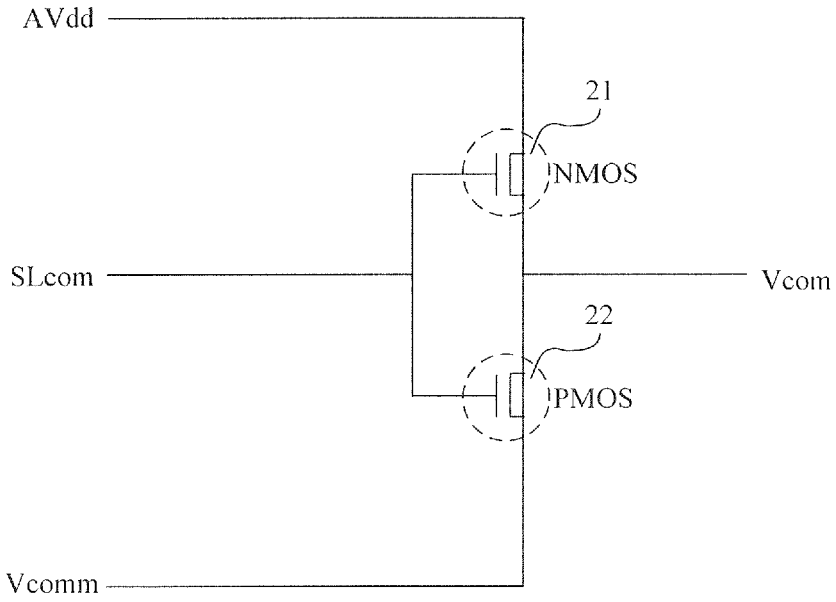
FIG. 4 is a schematic view illustrating a structure of a liquid crystal display driving apparatus according to a second embedment of the present invention.

FIG. 4 is a schematic view illustrating a structure of a liquid crystal display driving apparatus according to a second embedment of the present invention.

As shown in FIG. 4, a common voltage driving circuit of a source driving unit in the liquid crystal display driving apparatus comprises: an NMOS transistor 21 and a PMOS transistor 22. The gate electrodes of the NMOS transistor 21 and the PMOS transistors 22 are connected with a first control signal line (SLcom); the source electrode of the NMOS transistor 21 is connected with a first high level signal line (AVdd); the drain electrode of the PMOS transistor 22 is connected with the a work control signal line (Vcomm); and the drain electrode of the NMOS transistor 21 is connected with a source electrode of the PMOS transistor 22 and outputs a common voltage signal Vcom. The level of the signal Vcomm is about 0V-0.1V, preferably, 0.08V. In this way, when the voltage applied to the pixel electrode is attenuated over time, the work control signal Vcomm can be adjusted to attenuate along with the voltage applied to the pixel electrode, and this is helpful to control the display effect of the liquid crystal display. The level of the signal AVdd may be +10V, and the gamma voltage applied to the pixel region is 0-5V.

Figure 5:
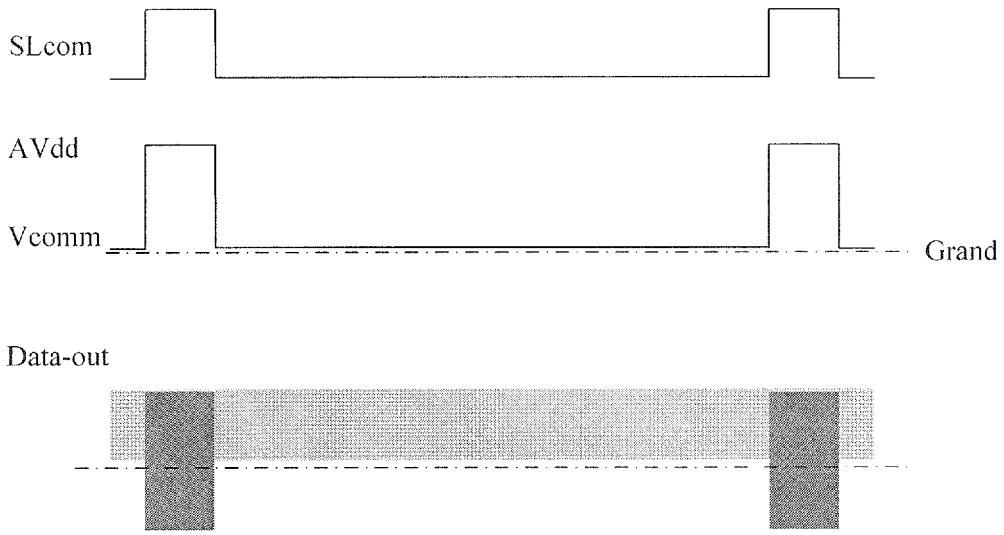
FIG. 5 is a timing sequence view of a common voltage driving circuit shown in FIG. 4.

FIG. 5 is a timing sequence view of the common voltage driving circuit shown in FIG. 4. As shown in FIGS. 5 and 4, when the first control signal SLcom is at a low level, the PMOS transistor 22 is turned on, the common voltage signal Vcom outputted from the source electrode of the PMOS transistor 22 is Vcomm, that is, Vcom=+0.08V. Here, for example, assuming that a same gray scale is displayed in each frame, that is, the pixel voltages applied to the pixel electrode are the same, if the unidirectional voltage signal applied to the pixel electrode is +2V, the voltage difference for normal work is defined by the pixel voltage signal (+2V) minus the common voltage signal (0.08V), that is, 1.92V. Then, the liquid crystal molecules are tilted toward a direction at a certain angle so as to display a corresponding gray scale. When the first control signal SLcom is at a high level, the NMOS transistor 11 is turned on, the common voltage signal Vcom outputted from the drain electrode of the NMOS transistor 21 is the first high level signal AVdd, that is, Vcom=+10V. In this case, the voltage difference is defined by +2V minus +10V, that is, −8V. That is, a strong bias voltage that is opposite to and larger than the voltage difference for normal work is applied to the pixel. As a result, on one hand, the liquid crystal molecules can be strongly tilted toward a direction opposite to the tilt direction during normal display, that is, a full white or a full black frame is inserted into the normally displayed frames, so aging of the liquid crystal material and image sticking can be alleviated. On the other hand, the migration of all the impurity ions in the liquid crystal layer can be saturated, so the impurity ions do not move in a certain period during normal display; a periodical strong bias voltage provided under the control of the periodical change of the first control signal SLcom is applied to the common electrode, the migration of the impurity ions can be kept in a saturation state, and thus the image sticking can be further alleviated. The frequency and pulse width of the first control signal SLcom can be set arbitrarily as long as the above effect can be achieved. In the embodiment of the present invention, it is preferable that the pulse width is 0.1~10 ms and the period is defined by adding the pulse width to the period of one frame.

In the liquid crystal display apparatus of the present embodiment, the voltage applied to the common electrode is close to 0V, so it is easier to apply and control the voltage.

In another embodiment, the common voltage driving circuit of the source driving unit in the liquid crystal display driving apparatus comprises: a first NMOS transistor, a source electrode which is connected with a second high level signal line and a gate electrode of which is connected with a second control signal line; a second NMOS transistor, a source electrode of which is connected with a second low level signal line and a gate electrode of which is connected with a third control signal line; a third NMOS transistor, a source electrode of which is connected with a second work control signal line, a gate electrode of which is connected with a third high level signal line, and a drain electrode of which is connected with the drain electrodes of the first NMOS transistor and the second NMOS transistor and outputs a second common voltage signal; a fourth NMOS transistor, a source electrode of which is connected with the gate electrode of the third NMOS transistor, a gate electrode of which is connected with the third control signal line, and a drain electrode of which is grounded; a fifth NMOS transistor, a source electrode of which is connected with the gate electrode of the third NMOS transistor, a gate electrode of which is connected with the second control signal line, and a drain electrode of which is grounded.

Figure 6:
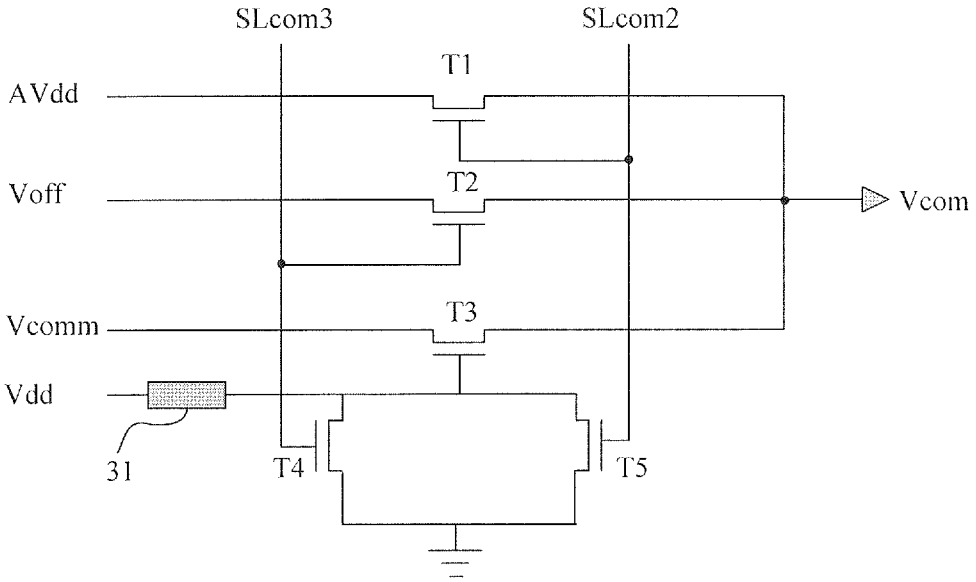
FIG. 6 is a schematic view illustrating a structure of a liquid crystal display driving apparatus according to a third embedment of the present invention.

FIG. 6 is a schematic view illustrating a structure of a liquid crystal display driving apparatus according to a third embedment of the present invention.

As shown in FIG. 6, the embodiment comprises first to fifth NMOS transistors T1~T5. The gate electrodes of the NMOS transistors T1 and T5 are connected with a second control signal line (SLcom2); the source electrode of the NMOS transistor T1 is connected with a second high level signal line (AVdd); the gate electrodes of the NMOS transistors T2 and T4 are connected with a third control signal line (SLcom3); the source electrode of the NMOS transistor T2 is connected with a second low level signal line (Voff); the source electrode of the NMOS transistor T3 is connected with the second work control signal line (Vcomm); the gate electrode of the NMOS transistor T3, the source electrode of the NMOS transistor T4, and the source electrode of the NMOS transistor T5 are linked together and further connected to a third high level signal line (Vdd) via a resistor 31; the drain electrodes of the NMOS transistors T4 and T5 are grounded; the drain electrodes of the NMOS transistors T1, T2, and T3 are linked together and output a second common voltage signal Vcom. The AVdd voltage may be +12V, the Voff voltage may be −8V, and the Vcomm voltage may be +5V.

In the present embodiment, the pixel voltage driving circuit of the source driving unit in the liquid crystal display driving apparatus generates a unidirectional voltage for applying to the pixel electrode in the pixel region. The level of the unidirectional voltage is in the range of 0-5V. The liquid crystal molecules are tilted at a certain angle by the voltage difference between the pixel electrode and the common electrode so as to display a required gray scale.

Figure 7:
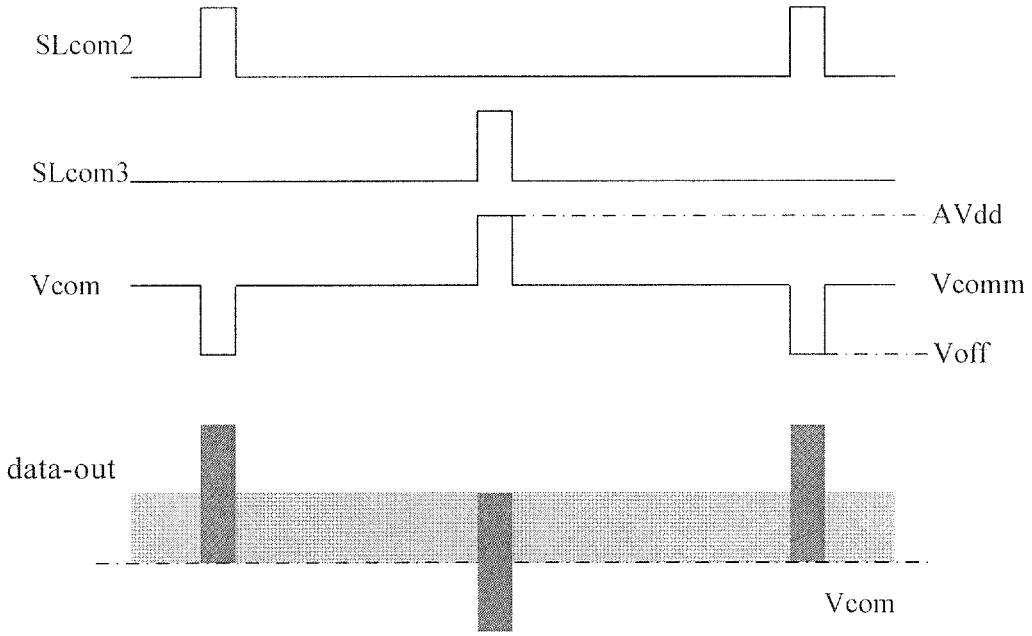
FIG. 7 is a timing sequence view of a common voltage driving circuit shown in FIG. 6.

FIG. 7 is a timing sequence view of the common voltage driving circuit shown in FIG. 6. As shown in FIGS. 7 and 6, assuming that a same gray scale is displayed in each frame, that is, the pixel voltages applied to the pixel electrode are the same, the unidirectional voltage signal applied to the pixel electrode is +2V. When the third control signal SLcom3 is at a high level, the second control signal SLcom2 is at a low level, the NMOS transistors T2 and T4 are turned on, the NMOS transistors T1, T3, and T5 are turned off, the second common voltage signal Vcom is the second low level signal Voff, that is, Vcom=−8V. Here, the voltage difference is defined by the pixel voltage signal (+2V) minus the common voltage signal (−8V), that is, 10V, so all of the pixels are strongly forward biased. When the third control signal SLcom3 is at a low level and the second control signal SLcom2 is at a high level, the NMOS transistors T1 and T5 are turned on, and the NMOS transistors T2, T3, and T4 are turned off, the second common voltage signal Vcom is the second high level signal AVdd, that is, Vcom=+12V. Here, the voltage difference is defined by the pixel voltage signal (+2V) minus the second common voltage signal (+12V), that is, −10V, so all of the pixels are strongly backward biased. When both of the second control signal SLcom2 and the third control signal SLcom3 are at a low level, the NMOS transistor T3 is turned on, the NMOS transistors T1, T2, T4, and T5 are turned off, the second common voltage signal Vcom is the second work control signal Vcomm, that is, Vcom=+5V. Here, the voltage difference is defined by the pixel voltage signal (+2V) minus the second common voltage signal (+5V), that is, −3V, which is in the normal work state, so the liquid crystal molecules are tilted reversely at a certain angle, and then the liquid crystal display normally displays the images. The periodical strong bias voltage produced under the control of the periodical change of the second control signal SLcom2 and the third control signal SLcom 3 is applied to the common electrode, so the migration of the impurity ions can be kept in a saturation state, and thus the image sticking can be further improved. The frequency and pulse width of the second control signal SLcom2 and the third control signal SLcom3 can be set arbitrarily as long as the above effect can be achieved. In the embodiment of the present invention, it is preferable that the pulse width is 0.1~10 ms and the period is defined by adding two pulse widths to two periods of displaying one frame.

In the liquid crystal display apparatus of the present embodiment, the voltage applied to the common electrode is bidirectional voltage with pulses, so the liquid crystal molecules are forcedly tilted in different directions after a period of normal work, so as to better prevent aging of the liquid crystal material compared with the above-described embodiment. Since the voltages having different directions may affect the different impurity ions to different degrees, so the impurity ions can be fixed to the saturated locations firmly by applying the bidirectional strong bias voltage.

The embodiment of the present invention also provides a liquid crystal display driving apparatus comprising a gate driving unit, a source driving unit, a gate line and a date line intersected with each other to define a pixel region. The source driving unit comprises a pixel voltage driving circuit and a common voltage driving circuit. The pixel voltage driving circuit is used to provide a unidirectional voltage signal applied to a pixel electrode in the pixel region and provide a periodical pulse high-voltage signal so as to drive the residence of the impurity ions and reverse the tilt of the liquid crystal molecules. The common voltage driving circuit is used to generate a common voltage signal corresponding to the unidirectional voltage signal generated by the pixel voltage driving circuit. The unidirectional voltage signal is applied to the pixel electrode in the pixel region. Since the electric field between the pixel electrode and the common electrode drives the liquid crystal molecules to tilt always in one direction for transmitting light, the flicker phenomenon, which is caused by different transmittances of light when bidirectional voltage is applied, can be effectively constrained. Further, application the unidirectional voltage can reduce the consumption of the power supply of the driving circuit and also can avoid using gamma resistors, so that the cost can be decreased. A periodical pulse high-voltage signal can be superimposed on the pixel electrode. As a result, on one hand, the liquid crystal molecules can be tilted in an opposite direction so as to prevent aging of the liquid crystal material, which may be caused when the liquid crystal molecules are tilted in one direction under the unidirectional voltage applied to the pixel electrode; on the other hand, the migration of the impurity ions in the liquid crystal molecules can be in a saturation state under the high-voltage pulse, however the voltage applied to the liquid crystal molecules is much smaller than the high-voltage pulse signal during normal display so the impurity ions can migrate slowly. In this way, periodical application of the bias voltage can keep the impurity ions from moving and be always in a saturation state, and thus the flicker phenomenon can be effectively improved.

Figure 8:
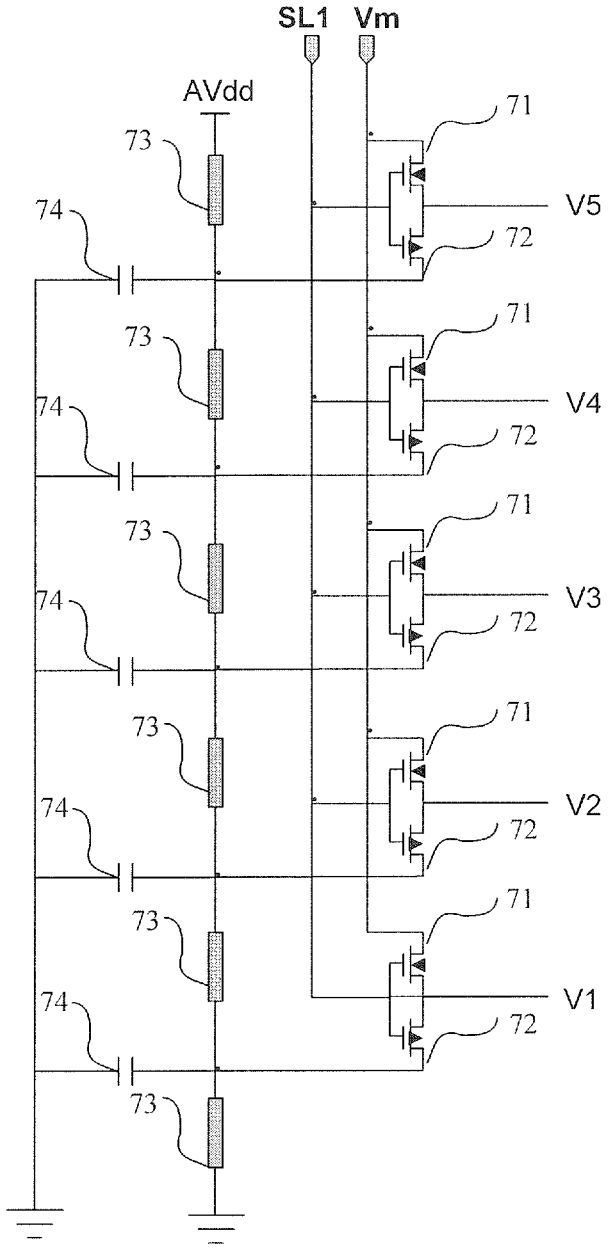
FIG. 8 is a schematic view illustrating a structure of a liquid crystal display driving apparatus according to a fourth embedment of the present invention.

FIG. 8 is a schematic view illustrating a structure of the liquid crystal display driving apparatus according to a fourth embodiment of the present invention.

As shown in FIG. 8, the pixel voltage driving circuit of the source driving unit in the liquid crystal display driving apparatus comprises: a resistor voltage divider circuit (RVD circuit) and a plurality groups of pixel voltage output circuits. The RVD circuit comprises a plurality of gamma resistors 73 and capacitors 74 connected with respective gamma resistors. The gamma resistors at the beginning and at the end of the RVD circuit are connected to a high level signal line (AVdd) and ground, respectively. Each group of the pixel voltage output circuit comprises a first NMOS transistor 71 and a first PMOS transistor 72 connected between two of the plurality of the gamma resistors 73. The gate electrodes of the first NMOS transistor 71 and the first PMOS transistor 72 are connected with the first control signal line (SL1); the source electrode of the first NMOS transistor 71 is connected with a bias voltage signal line (Vm); the drain electrode of the first PMOS transistor 72 is connected between two of the plurality of the gamma resistors 73; the drain electrode of the first NMOS transistor 71 is connected with the source electrode of the first PMOS transistor 72 and outputs a pixel voltage signal.

In the present embodiment, a pixel voltage driving circuit of the source driving unit in the liquid crystal display driving apparatus can produce and apply a unidirectional voltage to the pixel electrode within the pixel region, and the level of the unidirectional voltage may be in the range of 0-5V. The liquid crystal molecules are tilted at a certain angle by the voltage difference between the pixel electrode and the common electrode so as to display a required color.

In the present embodiment, the bias voltage signal Vm may be a first high level signal or a first low level signal.

Figure 9:
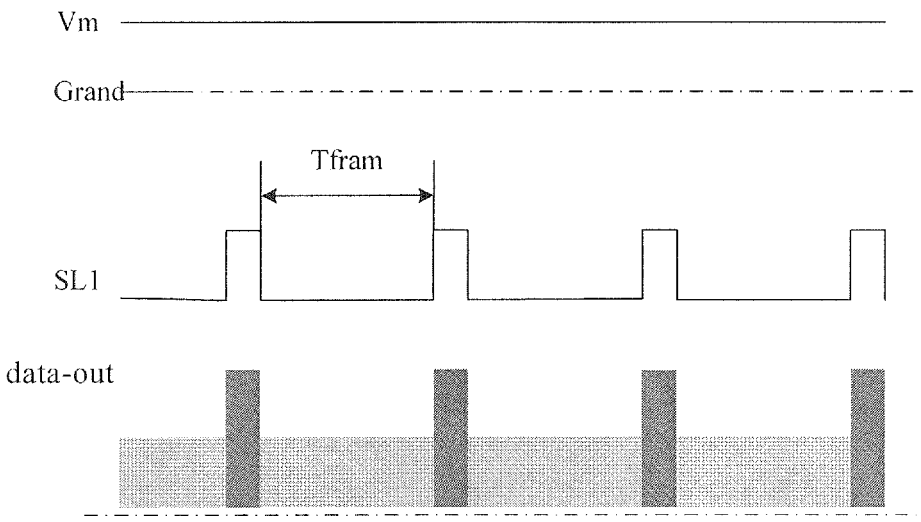
FIG. 9 is a timing sequence view of a pixel voltage driving circuit shown in FIG. 8.

FIG. 9 is a timing sequence view of the pixel voltage driving circuit shown in FIG. 8. As shown in FIGS. 9 and 8, when the bias voltage signal Vm is outputted as the first high level signal, that is, Vm=+12V, the work voltage applied to the common electrode can be +5V, that is, Vcom=+5V. When the first control signal SL1 is at a low level, in the pixel voltage driving circuit, all of the first PMOS transistors 72 are turned on and all of the first NMOS transistors 71 are turned off, the outputted pixel voltage signals are the pixel voltage required for normal display. Here, for example, assuming a same gray scale is displayed in each frame, that is, the pixel voltages applied to the pixel electrode are the same, if the unidirectional voltage signal applied to the pixel electrode is +2V, the voltage difference for normal work is defined by the pixel voltage signal (+2V) minus the common voltage signal (+5V), that is, −3V. Then, the liquid crystal molecules are tilted toward a direction at a certain angle so as to display a corresponding gray scale. When the first control signal SL1 is at a high level, in the pixel voltage driving circuit, all of the NMOS transistors 71 are turned on, all of the PMOS transistors 72 are turned off, and all of the pixel voltages output are the bias voltage Vm, that is, +12V. In this case, the voltage difference is defined by the pixel voltage signal (+12V) minus the common voltage signal (+5V), that is, +7V. That is, a strong bias voltage, which is larger than and opposite to the voltage difference during normal work, is applied to the pixel. As a result, on one hand, the liquid crystal molecules can be strongly tilted toward a direction opposite to the tilt direction during normal display, that is, a full white or a full black frame is inserted into the normally displayed frames, so aging of the liquid crystal material and image sticking are prevented; on the other hand, the migration of all the impurity ions in the liquid crystal layer can be saturated, so the impurity ions do not move in a certain period during normal display; a periodical strong bias voltage provided under the control of the periodical change of the first control signal SL1 is applied to the pixel electrode, so the migration of the impurity ions can be kept in a saturation state, and thus image sticking can be further alleviated. The frequency and pulse width of the first control signal SL1 can be set arbitrarily. In the embodiment of the present invention, it is preferable that the pulse width of the first control signal SL1 is set to 20Th and the period of the first control signal SL1 is Tfram+20Th, where Th is the time period of scanning of one row, and Tfram is the period of one frame. In addition, the first control signal SL1 of the present embodiment may be produced by a specific timing controller Tcon.

Figure 10:
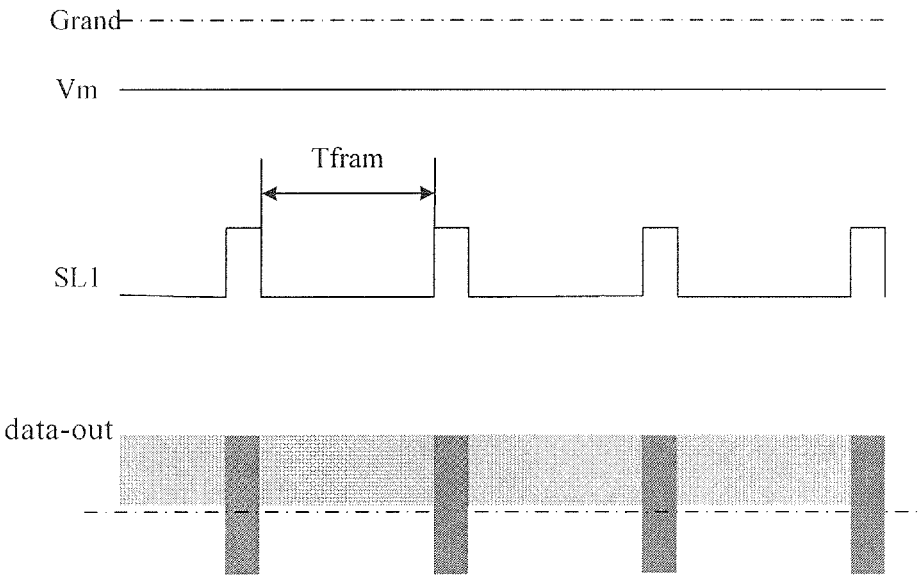
FIG. 10 is another timing sequence view of the pixel voltage driving circuit shown in FIG. 8.

FIG. 10 is another timing sequence view of the pixel voltage driving circuit shown in FIG. 8. As shown in FIGS. 10 and 8, when the bias voltage signal Vm is output as the first low level signal, that is, Vm=−8V, the work voltage applied to the common electrode may be 0-0.1V, preferably, Vcom=+0.08V. When the first control signal SL1 is at a low level, in the pixel voltage driving circuit, all of the first PMOS transistors 72 are turned on and all of the first NMOS transistors 71 are turned off, the outputted pixel voltage signals are the pixel voltage required for normal display. Here, for example, assuming a same gray scale is displayed in each frame, that is, the pixel voltages applied to the pixel electrode are the same, if the unidirectional voltage signal applied to the pixel electrode is +2V, the voltage difference for normal work is defined by the pixel voltage signal (+2V) minus the common voltage signal (+0.08V), that is, +1.92V. Then, the liquid crystal molecules are tilted toward a direction at a certain angle so as to display a corresponding gray scale. When the first control signal SL1 is at a high level, in the pixel voltage driving circuit, all of the NMOS transistors 71 are turned on, all of the PMOS transistors 72 are turned off, and all of the pixel voltages output the bias voltage Vm, that is, −8V. In this case, the voltage difference is defined by the pixel voltage signal (−8V) minus the common voltage signal (+0.08V), that is, −8.08V. That is, a strong bias voltage, which is larger than and opposite to the voltage difference during normal work, is applied to the pixel. As a result, on one hand, the liquid crystal molecules can be strongly tilted toward a direction opposite to the tilt direction during normal display, that is, a full white or a full black frame is inserted into the normally displayed frames so aging of the liquid crystal and image sticking are prevented; on the other hand, the migration of all the impurity ions in the liquid crystal layer can be saturated, so the impurity ions do not move in a certain period during normal display; a periodical strong bias voltage provided under the control of the periodical change of the first control signal SL1 is applied to the pixel electrode, so the migration of the impurity ions can be kept in a saturation state, and thus image sticking can be further alleviated. The frequency and pulse width of the first control signal SL1 can be set arbitrarily. In the embodiment of the present invention, it is preferable that the pulse width of the first control signal SL1 is set to 20Th and the period of the first control signal SL1 is Tfram+20Th, wherein Th is the time period of scanning of one row, and Tfram is the period of one frame. In addition, the first control signal SL1 of the present embodiment may be produced by a specific timing controller Tcon.

The liquid crystal display driving apparatus of the present invention may improve the quality of liquid crystal display from the following two aspects.

The first aspect is described below. When the unidirectional voltage signal is applied to the pixel electrode in the pixel region, only one tilt state of the liquid crystal molecules is necessary to consider. Thus, the requirements on the liquid crystal material and the polarization plates become lower, and it can prevent the flicker phenomenon generated by the bidirectional tilts of the liquid crystal molecules when the nearly symmetrical bidirectional voltage is applied. Also, the applied common electrode voltage of the liquid crystal display is changed from a fixed DC voltage into a periodical AC voltage with high-voltage pulse, so that the tilt state of the liquid crystal molecules are completely reversed by the high-voltage pulse of the common electrode voltage during one pulse (for example, a full white image is changed into a full black image), and thus image sticking and the trailing smear due to the persistence of version can be alleviated. Further, in the case of applying the unidirectional voltage, the dynamic range for driving the liquid crystal reduces by almost a half, so the consumption of displaying becomes lower. In addition, the gamma resistor in a COF also reduces by a half, so the cost of the chip is decreased. In this way, the gamma resistor in the chip can be designed according to the requirement of Transmition-Voltage curve.

The second aspect is described below. Because the impurity ions in the liquid crystal migrate to reside under the drive of the nearly symmetric voltage for a long time period, a bias field is generated and affects the tilt of the liquid crystal molecules, and thus image sticking occurs. With the liquid crystal display driving apparatus of the present invention, the migration of all the impurity ions in the liquid crystal layer can be saturated, so the impurity ions do not move in a certain period during normal display. In this way, the migration of the impurity ions can always be kept in the saturation state by application of the periodical strong bias voltage on the common electrode, and thus image sticking can be effectively alleviated. Before and after the saturation state of the migration of the impurity ions is achieved, the VT curve may shift to some degree. In this case, the common voltage signal Vcom for the normal work state is adjusted to compensate the effect of the electric field generated due to the impurity ions in the saturation state. In addition, the strong bias voltage opposite to the voltage for normal display is applied to the common electrode, aging of the liquid crystal material caused by application of unidirectional voltage signal during normal work can be effectively avoided.

Figure 11:
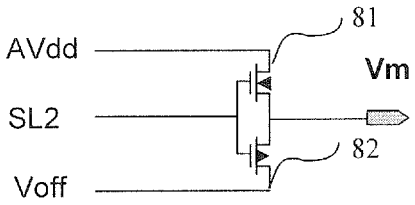
FIG. 11 is a schematic view illustrating a structure of a liquid crystal display driving apparatus according to a fifth embedment of the present invention.

FIG. 11 is a schematic view illustrating a structure of the liquid crystal display driving apparatus according to the fifth embodiment of the present invention.

The signal outputted from the circuit structure shown in FIG. 11 is used as the signal Vin shown in FIG. 7. As shown in FIG. 7, the pixel voltage driving circuit of the source driving unit in the liquid crystal display driving apparatus comprises: a resistor voltage divider circuit (RVD circuit) and a plurality groups of pixel voltage output circuits. The RVD circuit comprises a plurality of gamma resistors 73 and capacitors 74 connected with respective gamma resistors. The gamma resistors at the beginning and at the end of the RVD circuit are connected to a high level signal line (AVdd) and ground, respectively. Each group of the pixel voltage output circuit comprises a first NMOS transistor 71 and a first PMOS transistor 72 connected between two of the plurality of the gamma resistors 73. The gate electrodes of the first NMOS transistor 71 and the first PMOS transistor 72 are connected with the first control signal line, the source electrode of the first NMOS transistor 71 is connected with the bias voltage signal line (Vm), the drain electrode of the first PMOS transistor 72 is connected between two of the plurality of the gamma resistors 73, the drain electrode of the first NMOS transistor 71 is connected with a source electrode of the first PMOS transistor 72 and outputs a pixel voltage signal.

In the present embodiment, a pixel voltage driving circuit of the source driving unit in the liquid crystal display driving apparatus produce and apply a unidirectional voltage on the pixel electrode within the pixel region, the level of the unidirectional voltage may be in the range of 0-5V. The liquid crystal molecules are tilted at a certain angle by the voltage difference between the pixel electrode and the common electrode so as to display a required gray scale.

Figure 12:
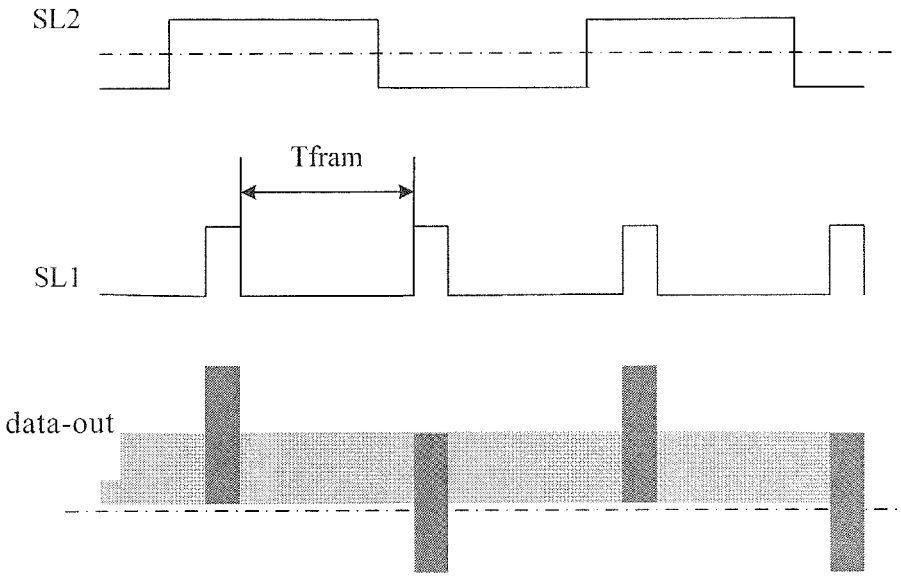
FIG. 12 is a timing sequence view of the pixel voltage driving circuit shown in FIG. 11 combined with the pixel voltage driving circuit shown in FIG. 8.

FIG. 12 is a timing sequence view of the pixel voltage driving circuit shown in FIG. 11 combined with the pixel voltage driving circuit shown in FIG. 8. As shown in FIGS.

12, 11 and 8, when the first control signal SL1 is at a low level, in the pixel voltage driving circuit, all of the first PMOS transistors 72 are turned on and all of the first NMOS transistors 71 are turned off, the outputted pixel voltage signals are the pixel voltage required for displaying natural colors. Here, for example, assuming a same gray scale is displayed in each frame, that is, the pixel voltages applied to the pixel electrode being the same, if the unidirectional voltage signal applied to the pixel electrode is +2V, the voltage difference for normal work is defined by the pixel voltage signal (+2V) minus the common voltage signal (+5V), that is, −3V. Then, the liquid crystal molecules are tilted toward a direction at a certain angle so as to display a corresponding gray scale.

When the first control signal SL1 is at a high level, in the pixel voltage driving circuit, all of the NMOS transistors 71 are turned on, all of the PMOS transistors 72 are turned off, and all of the pixel voltages output the bias voltage Vm, which is generated in the circuit structure as shown in FIG. 11. It is required that the first control signal SL1 provides a high level to drive the liquid crystal molecules to tilt at a certain direction when the second control signal SL2 is at a high level, and the first control signal SL1 also provides a high level to drive the liquid crystal molecules to tilt at another direction opposite to the previous tilt direction when the second control signal SL2 is at a low level. In the present embodiment, by considering the formality and the regularity of scanning, it is preferable that the second control signal SL2 is a square ware with a frequency that is a half of that of the first control signal SL1. When the second control signal SL2 is at a high level, in the pixel voltage driving circuit, the second NMOS transistor 81 is turned on, the second PMOS transistor 82 is turned off, and the bias voltage Vm is the positive bias voltage AVdd. When the second control signal SL2 is at a low level, in the pixel voltage driving circuit, the second NMOS transistor 81 is turned off, the second PMOS transistor 82 is turned on, and the bias voltage Vm is the negative bias voltage Voff. Therefore, when the first control signal SL1 is a high level signal and the second control signal SL2 is also at a high level, the pixel voltage in the pixel voltage driving circuit is Vm, that is, +12V. In this case, the voltage difference is defined by the pixel voltage signal (+12V) minus the common voltage signal (+5V), that is, +7V; when the first control signal SL1 is a high level signal and the second control signal SL2 is at a low level, the pixel voltage in the pixel voltage driving circuit is Vm, that is, −8V. In this case, the voltage difference is defined by the pixel voltage signal (−8V) minus the common voltage signal (+5V), that is, −13V. The frequency and pulse width of the first control signal SL1 can be set arbitrarily. In the embodiment of the present invention, it is preferable that the pulse width of the first control signal SL1 is set to 20Th and the period of the first control signal SL1 is Tfram+20Th, where Th is the time period of scanning of one line, and Tfram is the period of one frame. In addition, the first control signal SL1 and the second control signal SL2 of the present embodiment may be produced by a specific timing controller Tcon.

In the liquid crystal display apparatus of the present embodiment, the voltage applied to the common electrode is bidirectional voltage with pulses, so the liquid crystal molecules are forcedly tilted in a different direction after a period of normal work, so as to better prevent aging of the liquid crystal material. Since the voltages having different directions may affect the different impurity ions to different degrees, so the impurity ions can be fixed to the saturated locations firmly by applying the bidirectional strong bias voltage.

Finally, it should be noted that the above embodiments are only used to illustrate the solution of the present invention, but not a limitation. Although the above embodiments have been described the present invention in detail, it will be understood by those skilled in the art that modifications or alternation may be made therein; and all such modifications or alternation do not depart from the spirit and scope of the present invention.

What is claimed is:

1. A liquid crystal display driving apparatus comprising:
a gate driving unit,
a source driving unit, and
a gate line and a date line intersected with each other to define a pixel region, in which a pixel electrode and a common electrode are provided,
wherein the source driving unit comprises:
a pixel voltage driving circuit for providing a unidirectional voltage signal applied to the pixel electrode in the pixel region and for providing a periodical pulse high-voltage signal; and
a common voltage driving circuit for outputting a common voltage signal to the common electrode which corresponds to the unidirectional voltage signal provided by the pixel voltage driving circuit, the pixel voltage driving circuit being controlled by a first control signal line,
wherein the unidirectional voltage signal and the periodical pulse high-voltage signal are output depending on the first control signal line, and the periodical pulse high-voltage signal is a bias voltage signal,
wherein the unidirectional voltage signal is configured for displaying a required color, the pulse high-voltage signal is configured for displaying a full white or a full black frame, and the unidirectional voltage signal and the pulse high-voltage signal are alternately applied to the pixel electrode,
wherein the unidirectional voltage signal applied to the pixel electrode and the common voltage signal generate an electric field which drives liquid crystal molecules to tilt in one direction.

2. The liquid crystal display driving apparatus of claim 1, wherein the pixel voltage driving circuit comprises:
a resistor voltage divider circuit comprising a plurality of gamma resistors connected in series and capacitors connected with the respective gamma resistors; and
a plurality groups of pixel voltage output circuits,
wherein each group of pixel voltage output circuit is connected between two of the plurality of gamma resistors connected in series and comprises a first NMOS transistor and a first PMOS transistor.

3. The liquid crystal display driving apparatus of claim 2, wherein, gate electrodes of the first NMOS transistor and the first PMOS transistor are connected with the first control signal line, a source electrode of the first NMOS transistor is connected with a bias voltage signal line, a drain electrode of the first PMOS transistor is connected between two gamma resistors connected in series, a drain electrode of the first NMOS transistor is connected with a source electrode of the first PMOS transistor and outputs the unidirectional voltage signal applied to the pixel electrode.

4. The liquid crystal display driving apparatus of claim 3, wherein the bias voltage signal over the bias voltage signal line is selected from the group consisting of a first high level signal, a first low level signal and a high-low-alternating signal.

5. The liquid crystal display driving apparatus of claim 3, wherein when the bias voltage signal over the bias voltage signal line is a high-low-alternating signal, the pixel voltage driving circuit further comprises a second NMOS transistor and a second PMOS transistor.

6. The liquid crystal display driving apparatus of claim 5, wherein gate electrodes of the second NMOS transistor and the second PMOS transistor are connected with a second control signal line, a source electrode of the second NMOS transistor is connected with a second high level signal line, a drain electrode of the second PMOS transistor is connected with a second low level signal line, a drain electrode of the second NMOS transistor is connected with a source electrode of the second PMOS transistor and outputs the bias voltage signal.

7. The liquid crystal display driving apparatus of claim 1, wherein the periodical pulse high-voltage signal is an AC voltage signal.

* * * * *